United States Patent [19]

Hirao et al.

[11] Patent Number: 5,059,297

[45] Date of Patent: Oct. 22, 1991

[54] DURABLE ELECTRODE FOR USE IN ELECTROLYSIS AND PROCESS FOR PRODUCING THE SAME

[75] Inventors: Kazuhiro Hirao; Takanobu Hayashi, both of Kanagawa, Japan

[73] Assignee: Permelec Electrode Ltd., Kanagawa, Japan

[21] Appl. No.: 495,957

[22] Filed: Mar. 20, 1990

[30] Foreign Application Priority Data

Mar. 20, 1989 [JP] Japan ..... 1-66095

[51] Int. Cl.[5] ..... C25B 11/10

[52] U.S. Cl. ..... 204/290 R; 204/290 F

[58] Field of Search ..... 204/290 R, 290 F, 291, 204/292, 293

[56] References Cited

U.S. PATENT DOCUMENTS 4,696,731 9/1987 Tenhover ..... 204/290 R 4,702,813 10/1987 Tenhover ..... 204/290 R

*Primary Examiner*—John F. Niebling

*Assistant Examiner*—Kathryn Gorgos

*Attorney, Agent, or Firm*—Sughrue, Mion, Zinn, Macpeak & Seas

[57] ABSTRACT

An electrode for use in electrolysis is disclosed, which comprises a metallic substrate having formed on the surfaces thereof, in sequence, an amorphous layer free of grain boundaries, and an active electrode material coating. The electrode shows excellent durability even when used in electrolysis accompanied by oxygen evolution. A process for producing the electrode is also disclosed.

2 Claims, No Drawings

DURABLE ELECTRODE FOR USE IN ELECTROLYSIS AND PROCESS FOR PRODUCING THE SAME

FIELD OF THE INVENTION

The present invention relates to an electrode for electrolysis which can be used for various kinds of electrochemical reactions and to a process for producing the electrode. More particularly, it relates to an insoluble electrode for electrolysis which shows excellent durability when used in oxygen-evolving electrolysis and to a process for producing such an electrode.

BACKGROUND OF THE INVENTION

Electrodes formed by coating active electrode materials containing platinum group metal oxides on substrates made of corrosion-resistant metals represented by titanium are known as excellent insoluble electrodes and have been put to practical use. Such electrodes are now extensively used industrially in various electrochemical fields especially as chlorine-evolving anodes in the electrolysis of common salt water. Although various improvements of these kinds of electrodes have been made in electrochemical properties and physical properties including durability, the improvements so far made are not satisfactory. In particular, where electrolysis is conducted using as an electrolyte a solution containing sulfuric acid or a salt thereof, there is a problem in that the anode used has a short lifetime because an oxygen-evolving reaction takes place mainly at the anodes and hence, the electrode is exposed to an extremely severe environment. It is thought that the principal cause for this is that together with the erosion of the active electrode material coating, oxidation of both the coating and the substrate metal, but mostly of the substrate metal occurs at the interface between the substrate and the coating to form a poorly conductive oxide etc., which accumulates at the interface, and as a result, the electrode becomes passivated or the coating peels off.

For improving the poor durability of such electrodes, various means have been proposed, such as a method to provide intermediate layers of various materials between the substrates and electrode coatings to thereby protect the substrates. (See, for example, U.S. Pat. Nos. 3,775284, 4,468,416, 4,471,006, 4,481,097, 4,584,084, 4,581,117 and 4,765,879, and GB 2192008A)

With recent developments in the electrochemical industry, however, there has been a strong demand for improvements in product quality, production efficiency, etc., so that electrolysis is conducted under severe conditions, such as diversified electrolytes, increased current densities, heightened electrolysis temperatures, etc. Therefore, the electrodes used are desired to have further improved durability and other properties.

SUMMARY OF THE INVENTION

An object of the present invention is to provide an electrode for use in electrolysis which can be applied to various kinds of electrolytes and shows excellent durability particularly when used in electrolysis accompanied by oxygen evolution, thereby eliminating the above-described problem.

Another object of the present invention is to provide a process for producing the above electrode.

The present inventors have found that the problem of the conventional electrodes can be overcome by an electrode for electrolysis which is produced by forming an amorphous layer free of grain boundaries on the surface of a metallic substrate and then covering the amorphous layer with, an active electrode material.

That is, the present invention is an electrode for use in electrolysis which comprises a metallic substrate having formed on the surface thereof, in sequence, an amorphous layer free of grain boundaries, and an active electrode material coating.

DETAILED DESCRIPTION OF THE INVENTION

The above finding has been reached as follows. Insoluble electrodes obtained by coating active electrode materials on metallic substrates such as titanium were used to conduct electrolysis, and the process in which the electrodes became passivated or lost their usefulness was studied in detail. As a result, it has been found that oxidation of the substrate gradually proceeds from its surface, i.e., at the interface between the substrate and the coating, by an electrochemical action, and even if an intermediate layer of a metal oxide or the like is provided at the interface so as to prevent such oxidation described above, the oxidation of the substrate surface still proceeds in an ununiform manner when viewed microscopically, resulting in a microscopically uneven distribution of current density, owing to which the electrode reaches a passive state more rapidly.

Based on the above, it has now been found that by modifying those surfaces of a metallic substrate which undergo electrochemical oxidation so as to have a structure in which electrochemical oxidation proceeds uniformly, favorable results are obtained because current density distribution can be maintained uniformly even if the substrate surfaces are oxidized to some degree. Thus, the present invention has been accomplished. Particularly preferable as such a structure that produces the above effect is an amorphous metallic layer which is metallographically homogeneous and free of grain boundaries. Such an amorphous layer can be easily formed by vacuum sputtering or other means.

In the electrode of this invention, the substrate, which is made of a metallic material, is not particularly limited in composition and shape as long as it possesses electrical conductivity and moderate rigidity.

Preferred examples of the substrate material include valve metals having good corrosion resistance, such as Ti, Ta, Nb, and Zr, and alloys thereof. However, metals having good electrical conductivity such as Cu and Al may also be employed if the surfaces of the substrate are made to be sufficiently corrosion-resistant by means of non-corrodible coverings including an amorphous layer.

If necessary, the metallic substrate may suitably be subjected to physical and/or chemical pretreatments, such as annealing, surface-roughening treatment by, for example, blasting, and surface-cleaning treatment with, for example, acid, before an amorphous layer is formed on the substrate.

On the surface of the substrate, an amorphous layer free of grain boundaries is then formed. The material constituting the amorphous layer is not particularly limited as long as it has good electrical conductivity and corrosion resistance and shows good adhesion to the substrate and active electrode material. Representative materials for the amorphous layer include Ti, Ta, Nb, Zr, Hf, and alloys thereof, which have excellent corrosion resistance. These materials show especially good adhesion to substrates made of a valve metal such as Ti.

As a method for forming the amorphous layer of such a material on the metallic substrate, a thin film-forming technique using vacuum sputtering is employed. By a vacuum sputtering process, an amorphous thin film free of grain boundaries is obtained relatively easily. In carrying out a vacuum sputtering process, various apparatuses can be used such as those for direct-current sputtering, high-frequency sputtering, ion plating, ion-beam plating, and the cluster ion beam method. An amorphous thin film having the desired properties can be formed by suitably fixing each of the sputtering conditions such as degree of vacuum, substrate temperature, composition and purity of target(s), and deposition rate (applied power).

The thickness of such an amorphous layer formed for surface modification may generally be in the range of from about 0.1 to 10 μm. A proper thickness may be suitably selected from the standpoints of corrosion resistance and productivity and from other practical standpoints.

The substrate, the surface of which has been thus modified by forming the amorphous layer free of grain boundaries, was found to show excellent properties concerning thermal oxidation of the surface thereof. That is, it was found that the substrate shows a characteristic growth of an oxide layer. The above has been ascertained by the following experimental comparison.

A titanium plate obtained by degreasing a commercial pure titanium plate (TP28) and then treating the degreased titanium plate with an acid to clean the surface thereof and a surface-modified titanium plate obtained by coating a thin layer of pure titanium to a degreased and cleaned titanium plate, obtained in the same manner as above, by vacuum sputtering employing a pure titanium plate as a target were heat-treated in an air atmosphere for 0 to 5 hours in an electric oven of 450° to 600° C. having a uniform distribution of temperature under conditions which resulted in formation of a dense oxide layer on the titanium. As a result, it was found that compared to the former unmodified titanium plate, the latter surface-modified titanium plate had a uniform color tone and was free of unevenness of color such as spots, and the growth of the oxide layer on the latter plate was extremely uniform and proceeded at a low rate. These differences between the two substrates were clearly shown in the experiment. Such an effect of controlling the growth of the oxide layer can be enhanced by making the composition of the amorphous layer an alloy in place of a single metal.

It is thought that the above effect of the surface-modifying layer, i.e., the effect of controlling thermal oxidation to form a uniform oxide layer, brings about not only the effect of easing thermal effects during the step of coating an active electrode material as described below but also the effect of likewise easing electrochemical oxidation at the time when the final electrode is used for electrolysis, and thus, contributes greatly to the improvement in durability of the electrode.

The metallic substrate on which the amorphous layer has been formed is then overlaid with an active electrode material to give an electrode for electrolysis. The active electrode material is not particularly limited, and various known materials may be used depending on use of the electrode. However, where the electrode to be produced is for use in oxygen-evolving reactions, for which the electrode is required to have especially good durability, an active material coating containing an oxide of a platinum group metal such as ruthenium oxide or iridium oxide is preferred. It is also preferable for the purpose of improving the adhesion between the amorphous layer on the substrate and the active electrode material and also for improving the durability of the electrode, that a metal oxide such as $TiO_2$, $Ta_2O_5$, $Nb_2O_5$, $WO_3$, $HfO_2$, $ZnO_2$ or $SnO_2$ be incorporated in the active electrode material to give a compound oxide with the platinum group metal oxide.

There are various known methods for coating the active electrode material (see, for example, U.S. Pat. No. 3,711,385), and any suitable method can be employed. Among representative methods is a thermal decomposition process, in which a raw salt, such as a chloride, nitrate, alcoxide, or resinate, of a metal to be a constituent of the coating on the electrode is dissolved in a solvent such as hydrochloric acid, nitric acid, an alcohol, or an organic solvent to give a coating solution, which is applied on the surface of the above-described surface-modified substrate, and the resulting substrate is dried and then heat-treated in an oxidizing atmosphere such as air by means of a calcining oven. Other methods which can be employed to coat the active electrode material include a thick-film method in which a metal oxide is prepared beforehand, and this metal oxide is blended with a proper organic binder and organic solvent to give a paste, which is printed over the substrate, followed by calcination, and further includes the CVD method.

Before the active electrode material is thus coated, an intermediate layer may be formed on the surface-modified substrate. Such an intermediate layer may be formed by a method in which the above-described surface-modified substrate is subjected to heat treatment to form a very thin oxide layer as the intermediate layer on the surfaces of the substrate. Alternatively, a metallic oxide layer as the intermediate layer may be formed by the thermal decomposition method or CVD method. Due to the intermediate layer provided between the surface-modifying layer, i.e., the amorphous layer, and the active electrode material coating, the adhesion strength of the active electrode material coating is increased, and it can be expected that the substrate will be prevented from undergoing thermal oxidation and electrical oxidation. Thus, the intermediate layer serves, together with the amorphous layer on the substrate which produces the above-described substantial effects, to attain further improved durability of the electrode.

As described above, since the electrolytic electrode of the present invention is produced by forming an amorphous layer free of grain boundaries on the surfaces of a metallic substrate and then coating an active electrode material to the amorphous layer, the thermal and electrochemical oxidation of the substrate surfaces is controlled, and such oxidation proceeds extremely uniformly even when viewed microscopically. As a result, the electrode is effectively prevented from reaching a passive state and the coating is effectively prevented from peeling off. Therefore, an insoluble electrode for electrolysis can be obtained which shows significantly improved durability and, hence, can be satisfactorily used particularly for oxygen-evolving electrolysis.

Furthermore, because the amorphous layer is formed by vacuum sputtering, the surface modification of the metallic substrate can be conducted easily to impart the desired properties to the surfaces.

The present invention will be explained below in more detail by reference to the following Examples, but the present invention should not be limited thereto. Unless otherwise indicated, all percents, parts, ratios, etc., are by weight.

EXAMPLE 1 AND COMPARATIVE EXAMPLE

The surface of a JIS class 1 titanium plate (TP28) was subjected to dry blasting treatment with iron grits (#70) and then to acid-cleaning treatment in a 20% aqueous solution of sulfuric acid (90° C.) for 30 minutes. The substrate thus cleaned was set in a high-frequency sputtering apparatus and titanium was coated onto the substrate by sputtering of pure titanium. Coating conditions were as follows.

Target : JIS class 1 titanium disk (back side being water-cooled)

Degree of vacuum : $1.0\times10^{-2}$ Torr (replacement Ar gas being introduced)

Applied power : 500 W (3.0 KV)

Substrate temperature : 150° C. (during sputtering)

Time : 35 minutes

Coating thickness : 3.69 μm (calculated from weight increase)

Upon X-ray diffractometric analysis after the coating by sputtering, a sharp peak assigned to the crystalline substrate bulk and a broad pattern assigned to the coating formed by sputtering were observed, showing that the coating was amorphous. Further, the sample obtained above was cut and the cut side of the sample was slightly etched with a 5% hydrofluoric acid solution. As a result, other grain structure or other similar structure was observed on the surface coating formed by sputtering although corrosion was observed over the whole coating.

Thereafter, iridium tetrachloride and tantalum pentachloride were dissolved in a 35% hydrochloric acid to give a coating solution, and this coating solution was applied by brushing on the above-obtained substrate which had the amorphous layer formed by sputtering as described above. The resulting substrate was dried and then subjected to thermal decomposition treatment in an air-circulating electric oven at 550° C. for 20 minutes to form a coating. The amount of the coating solution thus applied for one such operation described above was fixed at about 1.0 g/m$^2$ in terms of elemental iridium. By repeating the above application-calcination operation three times, six times, and twelve times on the same substrates as above, three kinds of electrodes were prepared, respectively. The electrodes thus obtained were subjected to the same lifetime evaluation as follows. Electrolysis was conducted under conditions of a 150 g/1 aqueous sulfuric acid solution of 60° C., 300 A/dm$^2$, and with a Zr plate as the other electrode, and the time period required for the cell voltage to increase by 2.0 V from the initial value was taken as the lifetime of the electrode.

For the purpose of comparison (Comparative Example), electrode samples were prepared and evaluated in the same manner as described above except that vacuum sputtering to form an amorphous coating was omitted. The results obtained are summarized in Table 1.

TABLE 1

| Example | Sample No. | Substrate | Cleaning treatment | Modification treatment | Active material coating | Lifetime of electrode (hr) | Remarks |
|---|---|---|---|---|---|---|---|
| 1 | 1 | TP28 | blasting and acid-cleaning | pure titanium sputtering layer | 3 times | 72.2 | After electrolysis the residual coatings were tenaciously bonded to the substrates. |
| " | 2 | " | blasting and acid-cleaning | pure titanium sputtering layer | 6 times | 223.7 | |
| " | 3 | " | blasting and acid-cleaning | pure titanium sputtering layer | 12 times | 560.0 | |
| Comp. Ex. 1 | 4 | TP28 | blasting and acid-cleaning | none | 3 times | 61.0 | After electrolysis the residual were peeled off easily. |
| Comp. Ex. 1 | 5 | " | blasting and acid-cleaning | " | 6 times | 178.9 | |
| Comp. Ex. 1 | 6 | " | blasting and acid-cleaning | " | 12 times | 193.1 | |

As Table 1 shows, it is clear that the electrodes of this invention in which the substrate surfaces have been modified in a specific manner have greatly improved durability, which is enhanced significantly by increasing the thickness of the active electrode material coating.

EXAMPLE 2

A surface-modified substrate sample was prepared in the same manner as in Example 1 except that vacuum sputtering to form an amorphous coating was conducted under the following conditions.

Target : titanium-tantalum disk obtained by sintering a powdery mixture of Ti and Ta (back side being water-cooled) (composition, 60 mol% Ti and 40 mol% Ta)

Degree of vacuum : $1.0\times10^{-2}$ Torr (replacement Ar gas being introduced)

Applied power : 450 W (2.9 KV)

Substrate temperature : 150° C. (during sputtering)

Time : 30 minutes

Coating thickness : 3.82 μm (calculated from weight increase)

Upon X-ray diffractometric analysis of the substrate sample obtained, a broad pattern was observed which was attributed to the Ti-Ta coating formed by the sputtering and which showed that this coating was amorphous. This sample was cut and the cut side surface was examined, but no grain structure or other similar structure was observed thereon.

The substrate sample obtained above was then overlaid twelve times with an active electrode material coating of $IrO_2$-$Ta_2O_5$. The electrode thus produced was evaluated for lifetime in the same manner as in Example 1. As a result, its lifetime was found to be 1,446 hours, and after the lifetime, the residual coating was found to be tenaciously bonded to the substrate.

While the invention has been described in detail and with reference to specific embodiments thereof, it will be apparent to one skilled in the art that various changes and modifications can be made therein without departing from the spirit and scope thereof.

What is claimed is:

1. An electrode for use in electrolysis which comprises a metallic substrate having formed on a surface thereof, in sequence, an amorphous metal; layer free of grain boundaries consisting of a metal selected from the group consisting of Ti, Ta, Nb, Zr, and Hf or an alloy of any two or more of said metals and an active electrode material coating containing an oxide of a platinum group metal.

2. An electrode as in claim 1, which has an intermediate layer made of a metal oxide between said amorphous metal layer and said active electrode material coating.

* * * * *